US005228919A

United States Patent [19]

Baker

[11] Patent Number: 5,228,919

[45] Date of Patent: Jul. 20, 1993

[54] PAINT SPRAY SYSTEM

[75] Inventor: William R. Baker, Phoenix, Ariz.

[73] Assignee: Karsten Manufacturing Corp., Phoenix, Ariz.

[21] Appl. No.: 898,428

[22] Filed: Jun. 15, 1992

[51] Int. Cl.[5] ..... B05B 3/00

[52] U.S. Cl. ..... 118/323

[58] Field of Search ..... 118/323, 309; 239/227, 239/264, 692, 694, 751, 752

[56] References Cited

U.S. PATENT DOCUMENTS

| | | | |
|---|---|---|---|
| 2,344,108 | 3/1944 | Roselund . | |
| 3,418,971 | 11/1964 | Lamm | 118/626 |
| 3,592,387 | 7/1971 | Pilott et al. | 118/323 |
| 3,709,190 | 1/1973 | Von Gottberg et al. | 118/2 |
| 4,125,035 | 11/1978 | Dooley | 74/480 R |
| 4,373,959 | 4/1983 | Susnjara | 414/732 |
| 4,532,148 | 7/1985 | Vecellio | 427/31 |
| 4,613,082 | 9/1986 | Gimple et al. | 239/690 |
| 4,660,771 | 4/1987 | Chabert et al. | 239/694 |
| 4,679,734 | 7/1987 | Mommsen et al. | 239/692 |
| 4,690,328 | 9/1987 | Roehl | 239/227 |
| 4,779,804 | 10/1988 | Baba et al. | 239/690 |
| 4,798,341 | 1/1989 | Gimple | 239/694 |
| 4,829,881 | 5/1989 | Taki et al. | 92/88 |

*Primary Examiner*—Peter Chin
*Assistant Examiner*—Charles K. Friedman
*Attorney, Agent, or Firm*—Darrell Marquette

[57] ABSTRACT

A paint spray system includes a spray gun for ejecting paint toward work pieces carried in a generally horizontal direction by a conveyor chain. A pneumatic actuator moves the spray gun in a generally vertical direction as paint is ejected from the spray gun. The pneumatic actuator includes a casing, a piston disposed in the casing for reciprocating movement therein, and a load plate connected to the piston for carrying the spray gun. The piston defines an upper chamber and a lower chamber in the casing. When compressed air is delivered into the upper chamber, the piston and the load plate are moved in a downward direction. When compressed air is delivered into the lower chamber, the piston and the load plate are moved in an upward direction.

14 Claims, 5 Drawing Sheets

FIG. 1
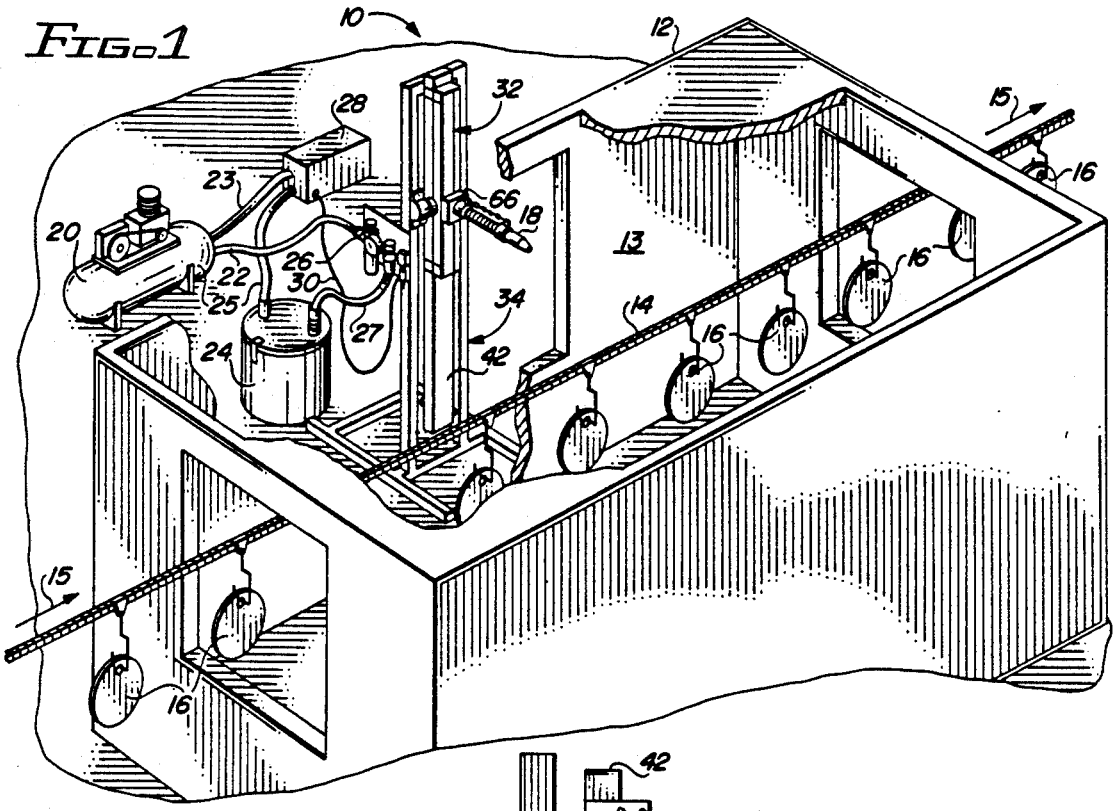
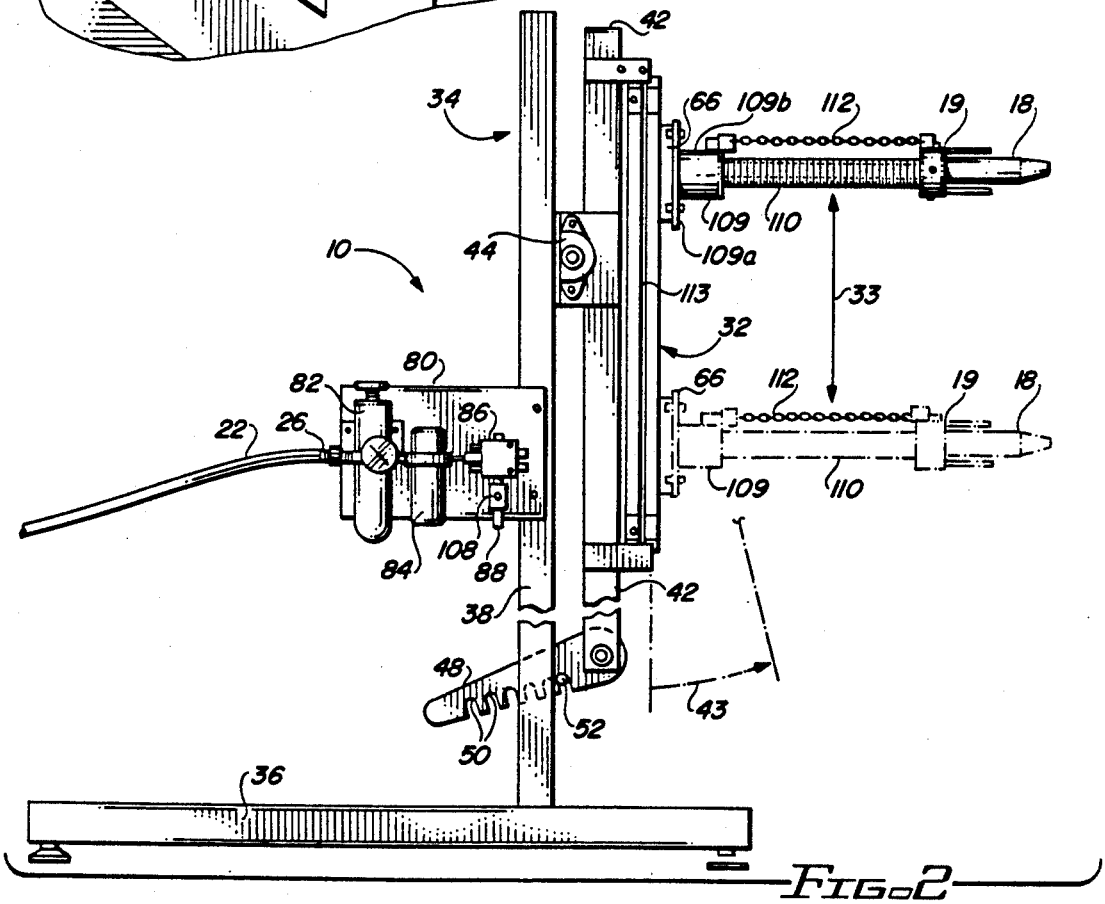
FIG. 2

PAINT SPRAY SYSTEM

BACKGROUND OF THE INVENTION

This invention relates generally to paint spray systems and, in particular, to a pneumatically controlled paint spray system.

Powder paint has been developed to minimize environmental concerns by avoiding use of solvents found in liquid paint. In powder paint operations, fine particles of colored powder are positively charged upon ejection from a spray gun. The ejected powder is attracted to and is electrostatically bonded to a negatively charged work piece disposed in a paint booth. This electrostatic bonding temporarily affixes the powder to the work piece. Subsequent heat treating melts the powder and thus permanently affixes it to the work piece.

During powder painting operations, some of the fine particles of powder do not bond to the work piece and become suspended in the atmosphere in the vicinity of the paint booth. Since existing systems for applying powder paint utilize either electrically controlled or hydraulically controlled spray gun mechanisms, complex and costly shielding must be provided to maintain a spark free environment in and around the paint booth in order to prevent an explosion of the suspended powder. Furthermore, both electrically controlled spray gun mechanisms and hydraulically controlled spray gun mechanisms are very expensive and complex. In addition, the suspended powder results in frequent cleaning of spray gun mechanims that are electrically controlled or hydraulically controlled to prevent them from malfunctioning.

SUMMARY OF THE INVENTION

An object of the present invention is to provide a pneumatically controlled paint spray system which avoids the aforementioned problems encountered with electrically or hydraulically controlled paint spray systems.

The present invention provides a paint spray system adapted for use with a paint booth and with conveyor means for carrying work pieces into the paint booth. The paint spray system comprises a spray gun for ejecting paint toward the work pieces as they are carried by the conveyor means in a first direction through a spray zone located inside the paint booth. Pneumatic actuator means are provided for moving the spray gun in a second direction as paint is ejected from the spray gun. The second direction is substantially orthogonal to the first direction.

In the preferred embodiment of the paint spray system, the pneumatic actuator means includes a casing, a piston disposed in the casing for reciprocating movement therein, and a load plate connected to the piston for carrying the spray gun in the second direction. The first direction is generally horizontal while the second direction is generally vertical. The piston defines an upper chamber and a lower chamber in the casing. When compressed air is delivered into the upper chamber, the piston and the load plate are moved in a downstroke. When compressed air is delivered into the lower chamber, the piston and the load plate are moved in an upstroke.

BRIEF DESCRIPTION OF THE DRAWINGS

FIG. 1 is a perspective view of a paint spray system, a paint booth, and a conveyor according to the preferred embodiment of the present invention;

FIG. 2 is a side elevational view of the paint spray system shown in FIG. 1;

DESCRIPTION OF THE PREFERRED EMBODIMENT

Figure 3:
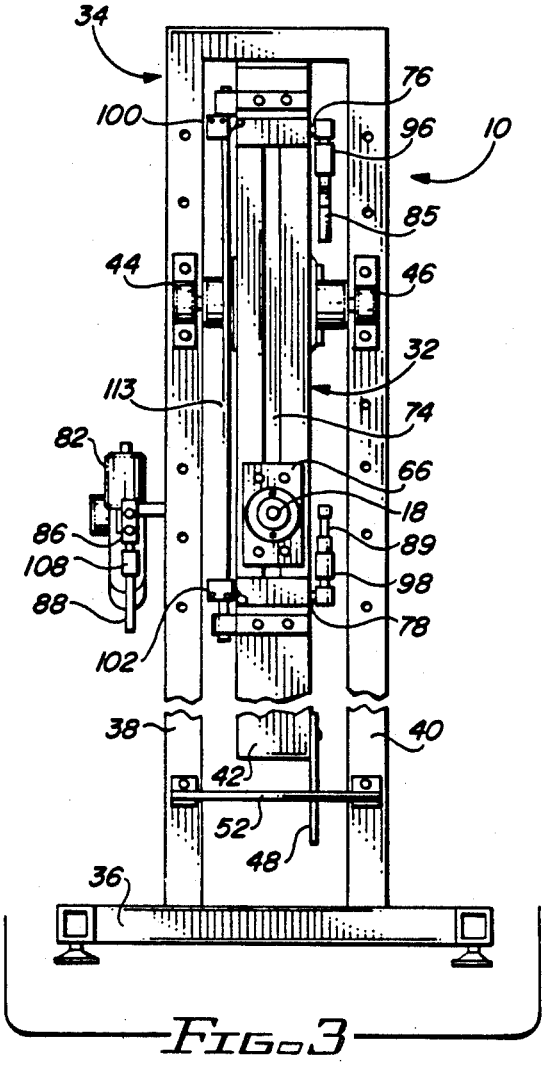
FIG. 3 is a front elevational view of the paint spray system shown in FIG. 1.

Referring to FIG. 1, a paint spray system 10 is disposed adjacent a paint booth 12. A conveyor chain 14 carries work pieces 16 through a spray zone 13 located inside the paint booth 12 and proximate to the spray system 10. Spray system 10 includes a pneumatic spray gun 18 which ejects a stream of electrostatically charged particles of powder paint toward the work pieces 16 as they are carried through the spray zone 13 by the conveyor chain 14 in a generally horizontal direction indicated by arrows 15.

A source of compressed air such as a conventional air compressor 20 is connected by a hose 22 to an inlet port 26 of a pneumatic actuator 32. The air compressor 20 is connected by a hose 23 to a control module 28. A hose 25 connects the control module 28 to a receptacle 24 containing paint, and a hose 27 connects the receptacle 24 to the spray gun 18. The control module 28 is connected to the spray gun 18 by electrical wiring 30. The paint particles are ejected from the spray gun 18 with a positive electrostatic charge. The control module 28 and the spray gun 18 are conventional parts that are commercially available from Ransburg Gema Inc. of Indianapolis, Ind.

The pneumatic actuator 32 provides vertical reciprocating movement of the spray gun 18 in a generally vertical direction indicated by a double arrow 33 (FIG. 2) which is substantially orthogonal to the generally horizontal direction indicated by the arrows 15. In the preferred embodiment of the spray system 10, the pneumatic actuator 32 is of a conventional type such as the model SRL Rodless Cylinder available from Miller Fluid Power of Bensenville, Ill. and disclosed in U.S. Pat. No. 4,829,881, incorporated herein by reference. As best illustrated in FIGS. 2 and 3, the pneumatic actuator 32 is supported in a generally vertical orientation by a stand 34 having a horizontal base 36 and a pair of vertical uprights 38, 40. The stand 34 also includes a vertically disposed intermediate element 42 which supports the pneumatic actuator 32 and which is rotatably mounted on the vertical uprights 38, 40 by pillow block bearing assemblies 44, 46.

An adjustment arm 48 pivotally mounted on the lower end of the intermediate element 42 has a plurality of notches 50 arranged for engagement with a horizontally disposed rod 52 that extends between and is connected to the vertical uprights 38, 40. Adjusting the arm 48 relative to the rod 52 enables the intermediate element 42 to be rotated about the bearing assemblies 44, 46 in the direction of arrow 43 to thereby adjust the generally vertical orientation of the intermediate element 42, the pneumatic actuator 32 and the spray gun 18.

Figure 4:
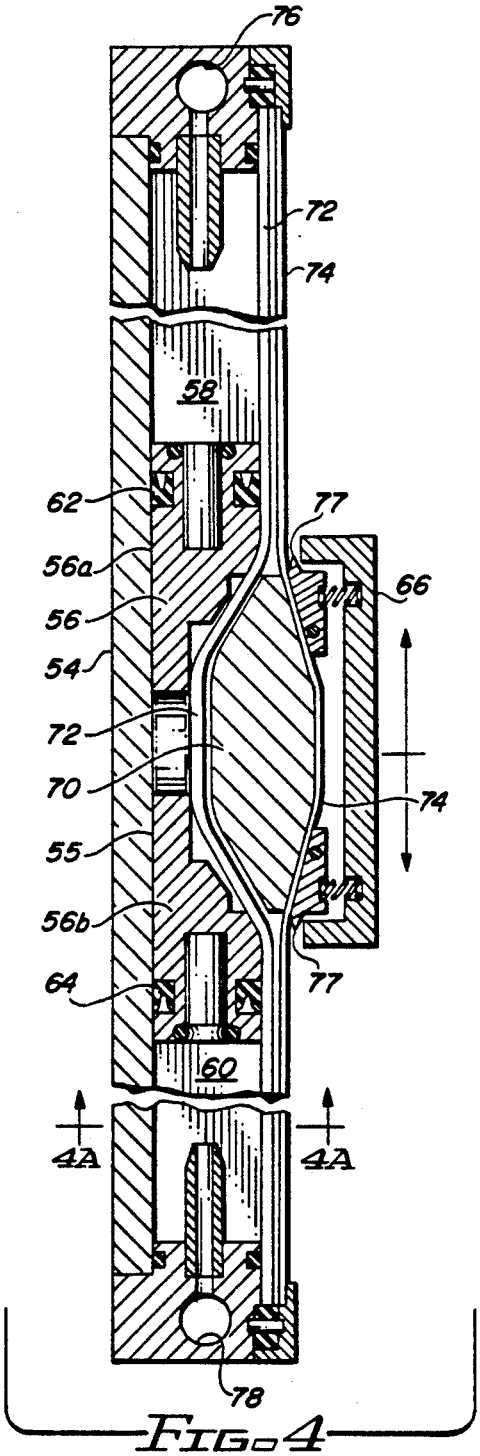
FIG. 4 is a longitudinal cross-sectional view of a pneumatic actuator used in the paint spray system of FIGS. 1, 2 and 3.
Figure 4A:
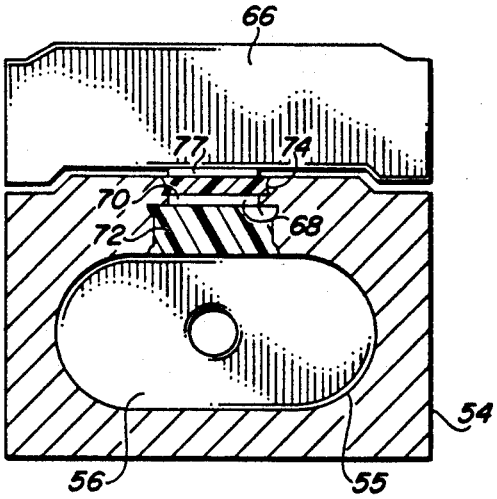
FIG. 4A is a sectional view taken along lines 4A—4A in FIG. 4.

Referring now to FIGS. 4 and 4A, the pneumatic actuator 32 includes a casing 54 which has a cavity 55 with an oval shaped cross-section. A piston 56 having an oval shaped cross-section is disposed in the cavity 55 for reciprocating movement and for defining an upper chamber 58 and a lower chamber 60 in the casing 54. A pair of O-rings 62, 64 carried on upper and lower portions **56*a*, 56*b* of the piston 56 sealingly separate the upper and lower chambers 58, 60 from each other. The casing 54 has a vertically oriented slit 68 formed therein for permitting clearance of a yoke 70 which interconnects the piston 56 and a load plate 66. A primary sealing belt 72 disposed on an inner side of the slit 68 passes behind the yoke 70 and provides an airtight seal between the chambers 58, 60 and the outside atmosphere. A secondary sealing belt 74 disposed on an outer side of the slit 68 passes in front of the yoke 70 preventing powder paint particles and other contaminants from entering the casing 54. A spring loaded block 77 carried at each end of the yoke 70 maintains constant pressure on the secondary sealing belt 74. The casing 54 also has an upper inlet port 76 and a lower inlet port 78 for delivering compressed air into the upper and lower chambers 58 and 60**, respectively.

As shown in FIG. 2, the hose 22 is connected to the inlet port 26 which is mounted on a plate 80. The plate 80 also supports an air regulator and filter 82, an air lubricator 84, and a shuttle valve 86. The shuttle valve 86 delivers compressed air to other pneumatic control elements illustrated in FIGS. 6A–6D. The schematic diagrams shown in FIGS. 6A–6D illustrate that the reciprocating movement of the piston 56 is controlled by the shuttle valve 86 having ports 92 and 94, flow control valves 96 and 98, limit switching valves 100 and 102 having mechanical actuator arms 104 and 106, and a toggle valve 108.

Figure 6B:
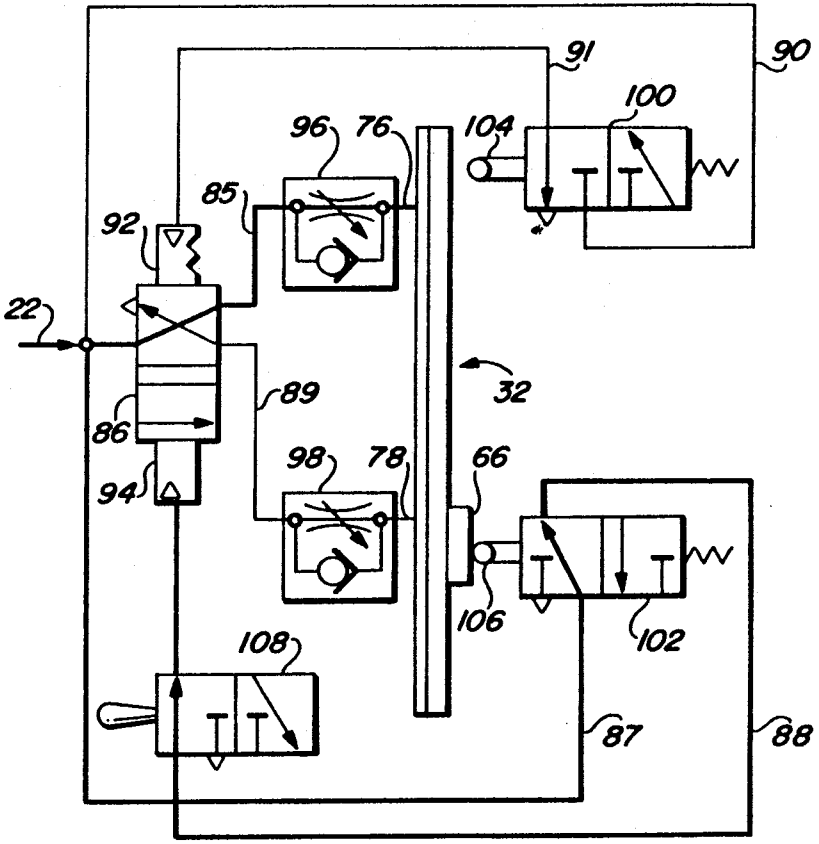
FIGS. 6A, 6B, 6C and 6D are schematic diagrams of the paint spray system of the present invention illustrating various configurations of the system during operation.
Figure 6A:
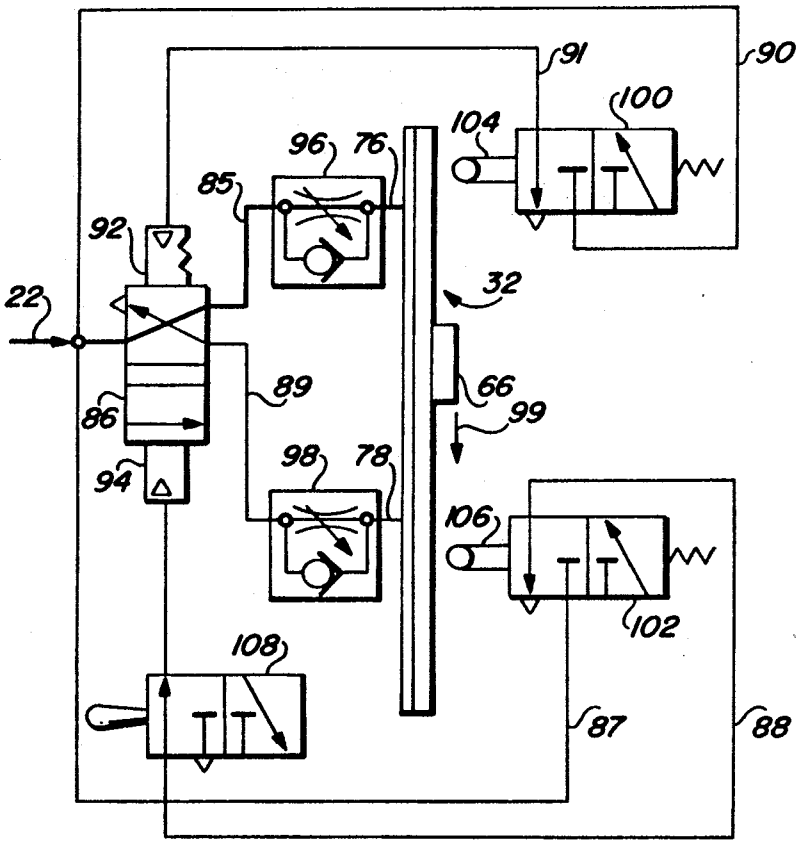

Referring to FIG. 6A, the various pneumatic control elements of the spray system 10 are illustrated in a downstroke configuration for moving the piston 56 and the load plate 66 in a downstroke. In this downstroke configuration, the shuttle valve 86 delivers compressed air from the hose 22 through the flow control valve 96 via a hose 85 to the upper inlet port 76 of the casing 54. Air pressure increases in the upper chamber 58 and moves the piston 56 and the load plate 66 in a downward direction indicated by an arrow 99. At the same time, air is exhausted from the lower chamber 60 by the flow control valve 98.

Figure 6D:
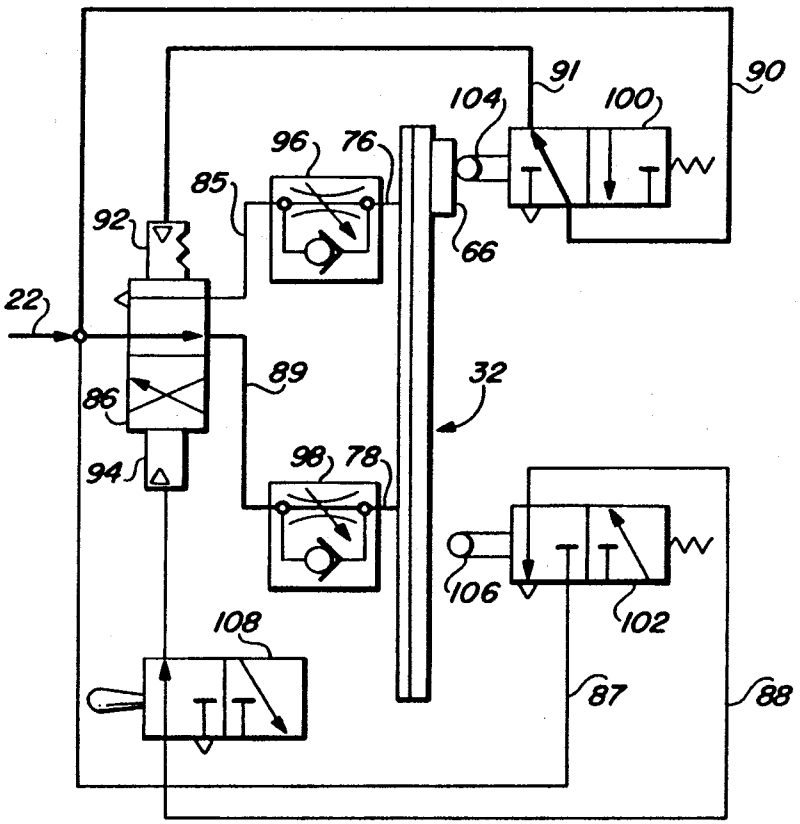
Figure 6C:
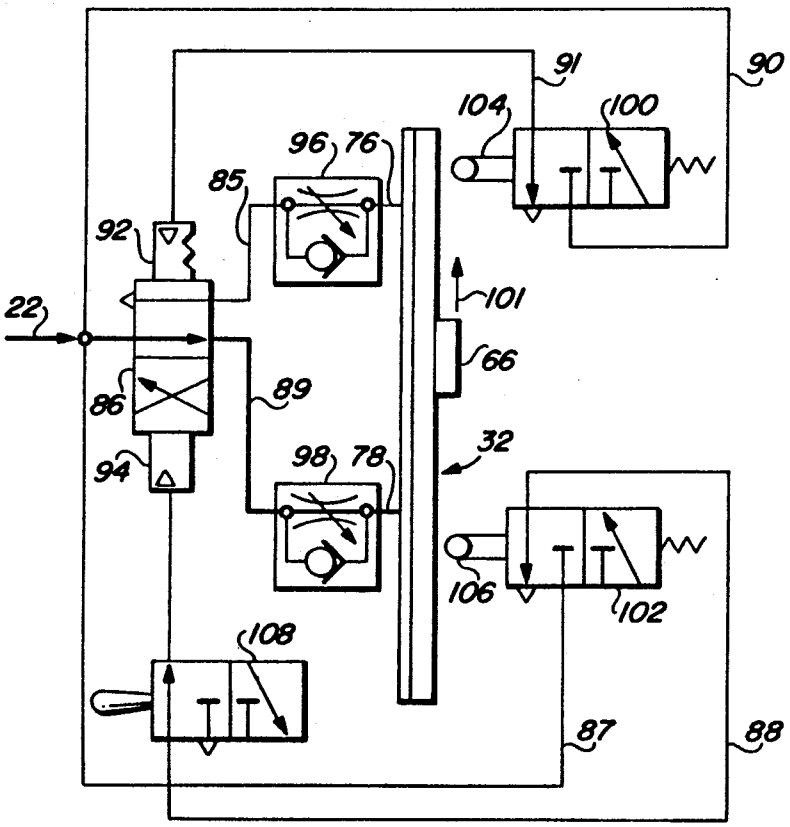

In FIG. 6B, the pneumatic control elements are illustrated in a bottom dead center configuration which is a transition from the downstroke configuration shown in FIG. 6A to an upstroke configuration shown in FIG. 6C. In this bottom dead center configuration, the load plate 66 has reached a lower position where it contacts the mechanical actuator arm 106 of the limit switching valve 102 which results in delivery of compressed air from the hose 22 through a hose 87, through the valve 102, and through another hose 88 to the port 94 of the shuttle valve 86 thereby reconfiguring the shuttle valve 86 to deliver compressed air from the hose 22 to the flow control valve 98 via a hose 89.

Referring to FIG. 6C, the pneumatic control elements are illustrated in the upstroke configuration for moving the piston 56 and the load plate 66 in an upstroke. Compressed air is delivered from the hose 22 through the flow control valve 98 via the hose 89 into the lower inlet port 78 of the casing 54 thereby increasing air pressure in the lower chamber 60 which results in movement of the piston 56 and the load plate 66 in an upward direction as indicated by an arrow 101. Simultaneously, air is exhausted from the upper chamber 58 by the flow control valve 96.

In FIG. 6D, the pneumatic control elements are illustrated in a top dead center configuration which is a transition from the upstroke configuration shown in FIG. 6C to the downstroke configuration shown in FIG. 6A. In this top dead center configuration, the load plate 66 has reached an upper position where it contacts the mechanical actuator arm 104 of the limit switching valve 100 resulting in delivery of compressed air from the hose 22 through a hose 90 and the valve 100 into the port 92 of the shuttle valve 86 via another hose 91. This reconfigures the shuttle valve 86 for delivering compressed air from the hose 22 through the hose 85 to the flow control valve 96.

The toggle valve 108 is manually operated and serves to open and close air flow between the limit switching valve 102 and the port 94 of the shuttle valve 86. In the configurations illustrated in FIGS. 6A through 6D, the toggle valve 108 is closed. When the toggle valve 108 is opened, it provides an "open circuit" condition that terminates reciprocating movement of the piston 56 and the load plate 66. With the toggle valve 108 opened, the piston 56 is moved downwardly to a rest position. The flow control valves 96, 98 control the velocity of the upward and downward movement of the piston 56 and the load plate 66. The valves 96, 98 are adjustable in order to regulate the upward and downward velocity of the piston 56 and the load plate 66.

In a typical operation, the piston 56 has a full stroke length of eighteen inches, and the flow control valves 96, 98 are adjusted so that the piston 56 reciprocates in the casing 54 at a velocity of fifteen strokes per minute. The pneumatic actuator 32 is typically operated at input air pressures of twenty-five pounds per square inch and at a flow rate of five cubic feet per minute.

Referring now to FIG. 2, the interconnection between the the spray gun 18 and the load plate 66 will be explained. A mounting bracket 109 includes a base **109*a* fastened to the load plate 66 and a cylindrical socket 109*b* for receiving one end of a coil spring 110. The spray gun 18 is mounted on a bracket 19 carried on the other end of the spring 110. Since the spring 110 is relatively stiff, it provides a substantially rigid connection between the bracket 109 and the spray gun 18 so that the spray gun 18 does not deflect significantly during normal operation of the pneumatic actuator 32. If the spray gun 18 contacts an obstacle, the spring 110 will permit the spray gun 18 to deflect and thus prevent damage to the paint spray system 10**.

The sudden reversal in the direction of movement of the spray gun 18 at the transitions between the upstroke and the downstroke of the piston 56 imparts a slight whipping action to the spray gun 18 due to the spring 110. The whipping action imparted to the spray gun 18 by the spring 110 is beneficial since it enhances the application of the powder paint onto the work pieces 16. As shown in FIG. 2, a chain 112 may be connected between the brackets 109 and 19 in order to limit the whipping action imparted to the spray gun 18 at the transition from the downstroke to the upstroke of the piston 56.

Figure 5:
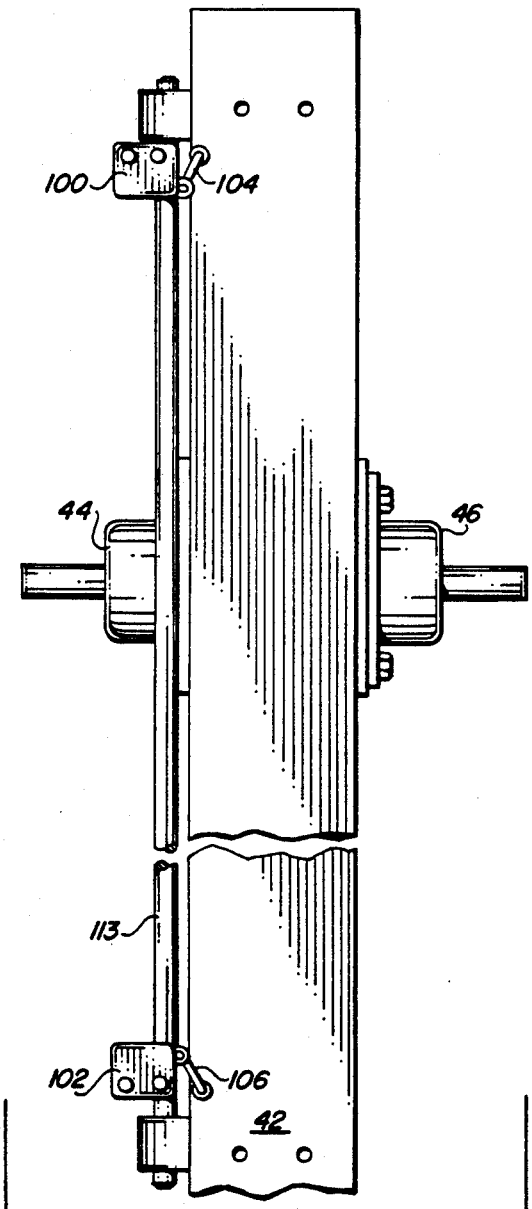
FIG. 5 is a rear elevational view, partly broken away, of the paint spray system shown in FIG. 1.

Referring to FIGS. 3 and 5, a bar 113 is mounted on the pneumatic actuator 32 and supports the limit switching valves 100, 102 in a manner such that these valves 100, 102 may be vertically repositioned along the bar 113. It will be understood that repositioning the valves 100, 102 will alter the top and bottom dead center transitions of the other pneumatic control elements 86, 96, 98 and the stroke length of the piston 56.

The particles of powder paint are ejected by the spray gun 18 with a positive electrostatic charge which results from friction generated as the paint particles travel through the spray gun 18 in a swirling motion. Since the conveyor chain 14 is grounded, the work pieces 16 have a negative electrostatic charge which promotes attraction of the paint particles. Alternatively, the positive and negative electrostatic charges applied to the paint particles and to the work pieces 16 could be reversed such that the paint particles would have a negative charge and the work pieces 16 would have a positive charge.

It will be understood that since the spray system 10 is controlled pneumatically, no shielding is needed to prevent explosion of powder paint that may be suspended in the atmosphere in the vicinity of the paint booth 12.

Figure 7:
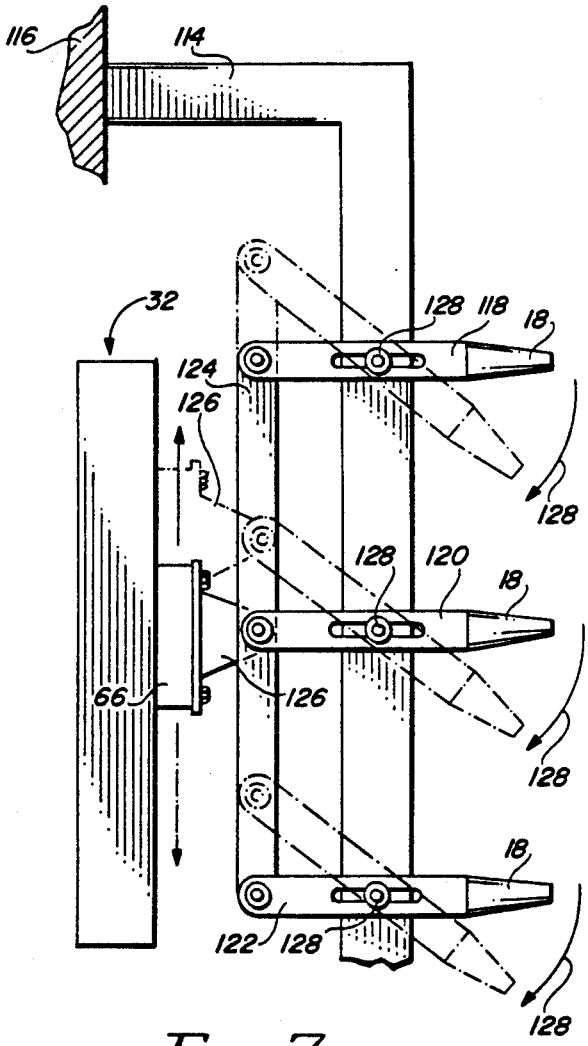
FIG. 7 is a side elevational view of an accessory for for use in the paint spray system of the present invention.

Referring to FIG. 7, an accessory for use in the paint spray system 10 is illustrated. This accessory includes a frame member 114 rigidly secured to a fixed point 116 such as the upper ends of the uprights 38, 40 of the stand 34. A plurality of spray guns 18 are mounted on outer ends of a plurality of arms 118, 120, 122 while inner ends of the arms 118, 120, 122 are pivotally connected to a link 124 which is pivotally mounted on the load plate 66 by a bracket 126. The arms 118, 120, 122 are pivotally and slidably coupled to the frame member 114 by bolts 128 which provide a connection permitting reciprocating and pivoting movement of the arms 118, 120, 122 relative to the frame member 114 as the load plate 66 is moved in upward and downward directions.

Although the paint spray system 10 is described in connection with the application of powder paint, it is understood that this system 10 may also be utilized to apply liquid paint.

What is claimed is:

1. A paint spray system for use with a paint booth, said paint spray system comprising:

conveyor means for carrying work pieces into said paint booth;

a spray gun for ejecting paint toward said work pieces as they are carried by said conveyor means in a generally horizontal direction through a spray zone located inside said paint booth;

pneumatic actuator means for moving said spray gun in a generally vertical direction as paint is ejected from said spray gun;

said pneumatic actuator means including a casing, a piston disposed in said casing for reciprocating movement therein, and a load plate connected to said piston for carrying said spray gun in said generally vertical direction;

a stand for supporting said pneumatic actuator means in a generally vertical orientation;

said stand including a horizontal base, a pair of vertical uprights, and an intermediate element rotatably mounted on said vertical uprights; and said pneumatic actuator being supported on said intermediate element of said stand.

2. The paint spray system of claim 1, further comprising a pair of bearing assemblies for rotatably mounting said intermediate element on said pair of vertical uprights.

3. The paint spray system of claim 2, further comprising an adjustment arm pivotally mounted on said intermediate element, said adjustment arm having a plurality of notches engageable with a rod which extends between said pair of vertical uprights in order to adjust the generally vertical orientation of said pneumatic actuator means.

4. The paint spray system for use with a paint booth, said paint spray system comprising:

conveyor means for carrying work pieces into said paint booth;

a spray gun for ejecting paint toward said work pieces as they are carried by said conveyor means in a generally horizontal direction through a spray zone located inside said paint booth;

pneumatic actuator means for moving said spray gun in a generally vertical direction as paint is ejected form said spray gun;

said pneumatic actuator means including a casing, a piston disposed in said casing for reciprocating movement therein, and a load plate connected to said piston for carrying said spray gun in said generally vertical direction;

said piston defining an upper chamber and a lower chamber in said casing;

a pair of O-rings carried on upper and lower portions of said piston for sealingly separating said upper and lower chambers from each other; and said casing having an upper inlet port for supplying compressed air to said upper chamber, and a lower inlet port for supplying compressed air to said lower chamber.

5. The paint spray system of claim 4, further comprising pneumatic control elements for controlling the reciprocating movement of said piston.

6. The paint spray system of claim 5, wherein said pneumatic control elements comprise a shuttle valve, first and second flow control valves, and a first and second limit switching valves.

7. The paint spray system of claim 6, wherein said pneumatic control elements have a downstroke configuration for moving said piston and said load plate in a downstroke when compressed air is delivered through said shuttle valve and through said first flow control valve into said upper chamber thereby increasing air pressure in said upper chamber and moving said piston and said load plate in a downward direction.

8. The paint spray system of claim 7, wherein said pneumatic control elements also have a bottom dead center configuration wherein said load plate contacts an arm on said first limit switching valve causing delivery of compressed air through said first limit switching valve to said shuttle valve thereby reconfiguring said shuttle valve to deliver compressed air to said second flow control valve.

9. The paint spray system of claim 8, wherein said pneumatic control elements have an upstroke configuration for moving said piston and said load plate in an upstroke when compressed air is delivered through said shuttle valve and through said second flow control valve into said lower chamber thereby increasing air pressure in said lower chamber and moving said piston and said load plate in an upward direction.

10. The paint spray system of claim 9, wherein said pneumatic control elements have a top dead center configuration wherein said load plate contacts an arm on said second limit switching valve causing delivery of compressed air through said second limit switching valve to said shuttle valve thereby reconfiguring said shuttle valve to deliver compressed air to said first flow control valve.

11. The paint spray system of claim 10, further comprising a bracket fastened to said load plate, a spring having one end thereof received in said bracket, and said spray gun being mounted on the other end of said spring.

12. The paint spray system of claim 11, wherein said spring imparts a whipping action to said spray gun at said top and bottom dead center configurations, and further comprising a chain connected between said bracket and said spray gun to limit the whipping action imparted to said spray gun at said bottom dead center configuration.

13. The paint spray system of claim 10, further comprising a bar connected to said pneumatic actuator means and supporting said limit switching valves in a manner such that said limit switching valves may be repositioned along said bar in order to alter said top and bottom dead center configurations of said pneumatic control elements.

14. A paint spray system for use with a paint booth, said paint spray system comprising:

conveyor means for carrying work pieces into said paint booth;

a spray gun for ejecting paint toward said work pieces as they are carried by said conveyor means in a first direction through a spray zone located inside said paint booth;

pneumatic actuator means for moving said spray gun in a second direction which is substantially orthogonal to said first direction as paint is ejected from said spray gun;

said pneumatic actuator means including a casing, a piston disposed in said casing for reciprocating movement therein, and a load plate connected to said piston for carrying said spray gun in said second direction;

a plurality of arms having inner ends thereof pivotally connected to a link which is pivotally mounted on said load plate; and a plurality of spray guns mounted on outer sends of said arms.

* * * * *